US007514987B2

(12) United States Patent
Lin

(10) Patent No.: US 7,514,987 B2
(45) Date of Patent: Apr. 7, 2009

(54) BANDGAP REFERENCE CIRCUITS

(75) Inventor: Ta Hsin Lin, Changhua Hsien (TW)

(73) Assignee: Mediatek Inc., Hsin-Chu (TW)

( * ) Notice: Subject to any disclaimer, the term of this patent is extended or adjusted under 35 U.S.C. 154(b) by 0 days.

(21) Appl. No.: 11/549,763

(22) Filed: Oct. 16, 2006

(65) Prior Publication Data

US 2007/0109037 A1 May 17, 2007

Related U.S. Application Data

(60) Provisional application No. 60/737,315, filed on Nov. 16, 2005.

(51) Int. Cl.
*G05F 1/10* (2006.01)

(52) U.S. Cl. ..... 327/539; 327/540; 327/541; 323/313

(58) Field of Classification Search ..... None
See application file for complete search history.

(56) References Cited

U.S. PATENT DOCUMENTS

| | | | | |
|---|---|---|---|---|
| 4,769,589 | A | 9/1988 | Rosenthal | |
| 4,896,094 | A | 1/1990 | Greaves et al. | |
| 5,212,458 | A | 5/1993 | Fitzpatrick et al. | |
| 5,448,770 | A | 9/1995 | Hietala et al. | |
| 5,453,679 | A | 9/1995 | Rapp | |
| 5,557,194 | A | 9/1996 | Kato | |
| 5,666,046 | A | 9/1997 | Mietus | |
| 5,889,394 | A | 3/1999 | Czamocki | |
| 6,020,792 | A | 2/2000 | Nolan et al. | |
| 6,091,285 | A | 7/2000 | Fujiwara | |
| 6,124,754 | A | 9/2000 | Afghani | |
| 6,160,391 | A | 12/2000 | Banba | |
| 6,181,121 | B1 | 1/2001 | Kirkland et al. | |
| 6,384,586 | B1 * | 5/2002 | Sugawara | 323/313 |
| 6,489,835 | B1 | 12/2002 | Yu et al. | |
| 6,563,295 | B2 | 5/2003 | Juang | |
| 6,563,371 | B2 | 5/2003 | Buckley et al. | |
| 6,690,228 | B1 * | 2/2004 | Chen et al. | 327/538 |
| 6,738,297 | B2 | 5/2004 | Di Iorio | |
| 6,771,117 | B2 | 8/2004 | Nakai | |
| 6,809,575 | B2 | 10/2004 | Oddone et al. | |
| 6,906,581 | B2 | 6/2005 | Kang et al. | |
| 6,933,770 | B1 | 8/2005 | Ranucci | |
| 7,119,528 | B1 | 10/2006 | Rasmus | |
| 2005/0237105 | A1 * | 10/2005 | Park | 327/539 |
| 2005/0264345 | A1 | 12/2005 | Ker et al. | |
| 2007/0080740 | A1 * | 4/2007 | Berens et al. | 327/539 |

* cited by examiner

*Primary Examiner*—An T Luu
(74) *Attorney, Agent, or Firm*—Thomas, Kayden, Horstemeyer & Risley

(57) ABSTRACT

Bandgap reference circuits capable operating in low voltage environments. In the bandgap reference circuit, a current generation circuit generates an output current obtained by combining a first current, a second current and a third current. The first current is converted from a first voltage and a first forward voltage of a first constant voltage generation element. The second current and the third current are both converted from a voltage difference between the first forward voltage and a second forward voltage of the second constant voltage generation element. A current-to-voltage generator converts the output current to an output voltage.

10 Claims, 2 Drawing Sheets

BANDGAP REFERENCE CIRCUITS

CROSS REFERENCE TO RELATED APPLICATIONS

This application claims the benefit of U.S. Provisional Application No. 60/737315, filed Nov. 16, 2005, and entitled "Low-voltage bandgap voltage reference circuit".

BACKGROUND OF THE INVENTION

1. Field of the Invention

The invention relates to reference circuits, and in particular to bandgap reference circuits capable of operating in low voltage environments while generating output with a nearly-zero temperature coefficient.

2. Description of the Related Art

Analog circuits incorporate voltage and current reference circuits extensively. Such reference circuits are DC quantities that exhibit little dependence on supply and process parameters and a well-defined dependence on the temperature. For example, bandgap reference circuits are probably the most popular high performance reference circuits, with the principle thereof to implement components having characteristics of positive temperature coefficient and negative temperature coefficient and add the voltages or current of these components in a predetermined proportion to generate a value independent of temperature, such value output as a reference. The conventional bandgap reference circuits use bipolar technology to create a stable low reference voltage at around 1.25V which is almost equal to the silicon energy gap measured in electron volts. However, in modem deep-submicron technology, a voltage of around 1V is preferred. As such, the conventional bandgap reference circuits are inadequate for current requirements.

BRIEF SUMMARY OF THE INVENTION

A detailed description is given in the following embodiments with reference to the accompanying drawings.

Embodiments of bandgap reference circuits are provided, in which a current generation circuit generates an output current, obtained by combining a first current, a second current and a third current. The first current is converted from a first voltage and a first forward voltage of a first constant voltage generation element. The second current and the third current are both converted from a voltage difference between the first forward voltage and a second forward voltage of the second constant voltage generation element. A current-to-voltage generator converts the output current to an output voltage.

The invention provides another embodiment of bandgap reference circuits, in which a current mirror comprises a control terminal, a first output terminal and a second output terminal, an operational amplifier comprises an output terminal coupled to the control terminal of the current mirror, and first and second input terminals. A first resistor is coupled between the first output terminal of the current mirror and the first input terminal of the operational amplifier. A second resistor is coupled between the first output terminal of the current mirror and the second input terminal of the operational amplifier, and a third resistor comprises a first terminal coupled to the first input terminal of the operational amplifier, and a second terminal. A first transistor is coupled between the second terminal of the third resistor and a ground voltage, and a second transistor is coupled between the ground voltage and the second input terminal of the operational amplifier. A fourth resistor is coupled between the ground voltage and the second output terminal of the current mirror.

The invention provides another embodiment of bandgap reference circuits, in which a current mirror comprises a control terminal, a first output terminal and a second output terminal, and an operational amplifier comprises an output terminal coupled to the control terminal of the current mirror, and first and second input terminals. A first resistor is coupled between the first output terminal of the current mirror and the first input terminal of the operational amplifier. A second resistor is coupled between the first output terminal of the current mirror and the second input terminal of the operational amplifier, and a third resistor comprising a first terminal coupled to the first input terminal of the operational amplifier, and a second terminal. A first transistor is coupled between the second terminal of the third resistor and a ground voltage, and a second transistor is coupled between the ground voltage and the second input terminal of the operational amplifier. A fourth resistor is coupled between the first output terminal and the second output terminal of the current mirror.

The invention provides another embodiment of bandgap reference circuits, in which a first MOS transistor is coupled between a power voltage and a first node, a second MOS transistor is coupled between the power voltage and an output terminal, and an operational amplifier comprises an output terminal coupled to the first and the second MOS transistors. A first resistor is coupled between the first node and the operational amplifier, a second resistor is coupled between the first node and the operational amplifier, and a third resistor is coupled to the first node and the operational amplifier. A first transistor is coupled between the third resistor and a ground voltage, a second transistor is coupled between the ground voltage and the second resistor, a fourth resistor is coupled to the first node; and a fifth resistor is coupled between the output terminal and the ground voltage.

The invention provides another embodiment of bandgap reference circuits, in which a current mirror produces a first current mirror output and a second current mirror output through a first output terminal and a second output terminal respectively, in response to a control signal. The first current mirror output comprises first and second current with negative temperature coefficient and a third current with positive temperature coefficient. A first resistor is coupled between the first output terminal and a first node to receive the first current, and a second resistor is coupled between the first output terminal and a second node to receive the second current. An operational amplifier is coupled to the first node and the second node to generate the control signal to control the current mirror according to voltages on the first and the second nodes. A third resistor comprises a first terminal coupled to the first input terminal of the operational amplifier, and a second terminal, and a first transistor is coupled between the second terminal of the third resistor and a ground voltage. A second transistor is coupled between the ground voltage and the second node, and a fourth resistor is coupled to the first output terminal to receive the third current.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
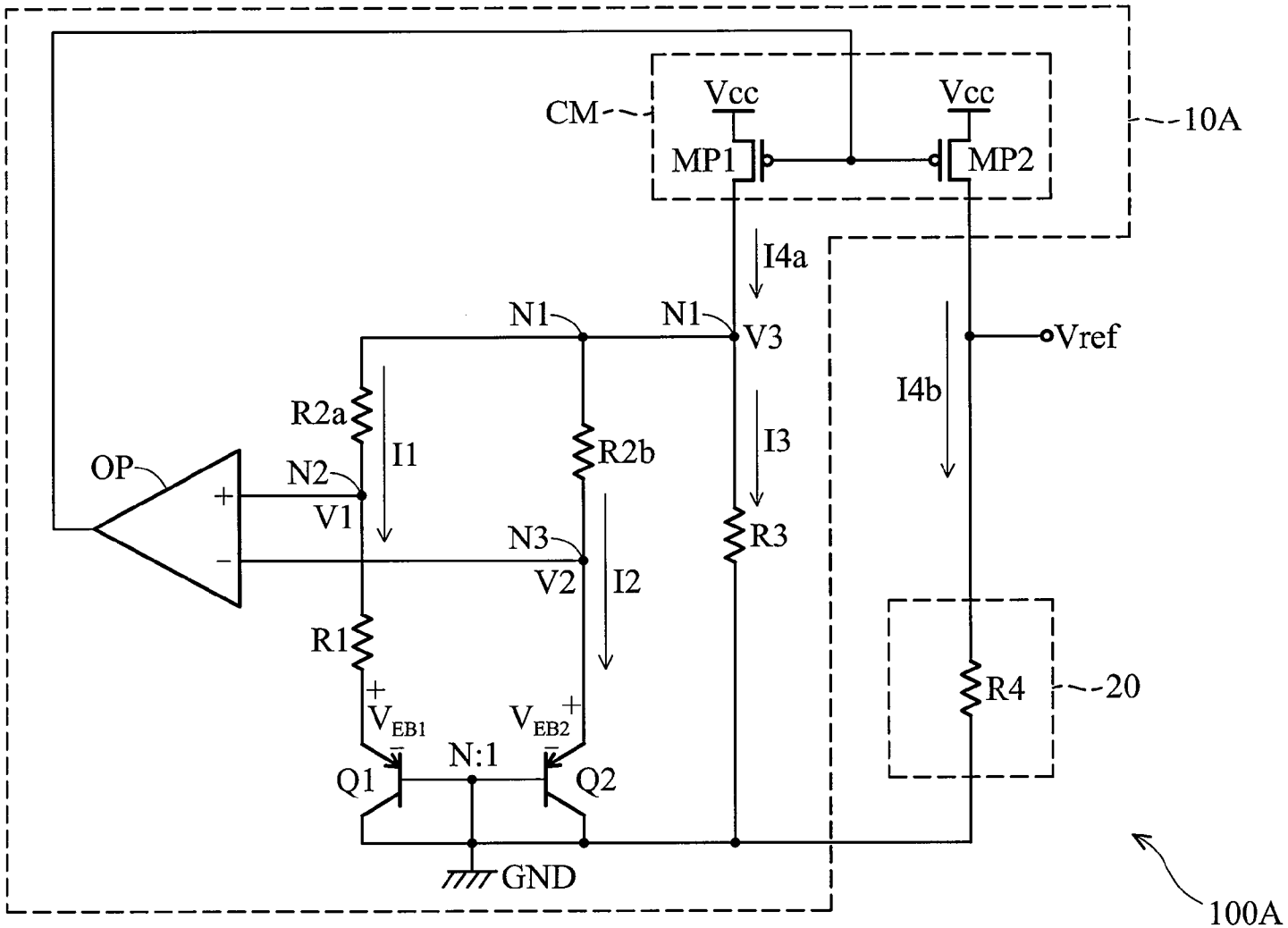
FIG. 1 shows an embodiment of a bandgap reference circuit.

FIG. 1 shows an embodiment of a bandgap reference circuit. As shown, a bandgap reference circuit 100A comprises a current generation circuit 10A and a current-to-voltage generator 20. The current generation circuit 10A generates two identical output currents I4*a* and I4*b*, and the current I4*b* is obtained by combining currents I1, I2 and I3 since the currents I4*a* and I4*b* are identical. The current-to-voltage generator 20 generates an output voltage Vref according to the current I4*b* generated by the current generation circuit 10A.

The current generation circuit 10A comprises a current mirror CM, an operating amplifier OP, resistors R1, R2*a*, R2*b* and R3, and two bipolar transistors Q1 and Q2, in which the current mirror CM comprises two PMOS transistors MP1 and MP2 and the resistors R2*a* and R2*b* have the same resistance. For example, the transistors MP1 and MP2 are the same size, and the emitter area of the transistor Q1 can be N times that of the transistor Q2, in which N>1. The current-to-voltage generator 20 can be a resistor, a resistive element, a passive element or combinations thereof. In this case, the current-to-voltage generator 20 comprises a resistor R4.

The transistor MP1 comprises a first terminal coupled to a power voltage Vcc, a second terminal coupled to a node N1, and a control terminal coupled to the transistor MP2. The transistor MP2 comprises a first terminal coupled to the power voltage Vcc, a control terminal coupled to the control terminal of the transistor MP1 and a second terminal coupled to the resistor R4. The resistor R3 is coupled between the node N1 and a ground voltage GND, the resistor R2*a* is coupled between the nodes N1 and N2, the resistor R2*b* is coupled between the nodes N1 and N3, and the resistor R1 is coupled between the node N2 and the transistor Q1.

The operational amplifier comprises a first terminal coupled to the node N2 and a second terminal coupled to the node N3, and an output terminal coupled to the control terminals of the transistors MP1 and MP2 in the current mirror CM. The operational amplifier OP outputs a control signal to control the current mirror CM according to the voltages at the nodes N2 and N3.

The transistor Q1 comprises an emitter coupled to the resistor R1 and a collector coupled to the ground voltage GND and a base coupled to the transistor Q2. The transistor Q2 comprises an emitter coupled to the node N3 and a collector coupled to the ground voltage GND and a base coupled to the base of the transistor Q1. In this case, the bases of the transistor Q1 and Q2 are coupled to the ground voltage GND. Namely, the transistors Q1 and Q2 are diode-connected transistors.

If the base current is neglected, the emitter-base voltage $V_{EB}$ of a forward active operation diode can be expressed as:

$$V_{EB} = \frac{kT}{q}\ln\left(\frac{I_C}{I_S}\right)$$

Wherein k is Boltzmannis constant ($1.38\times10^{-23}$ J/K), q is the electronic charge ($1.6\times10^{-29}$C), T is temperature, $I_c$ is the collator current, and $I_s$ is the saturation current.

When the input voltages V1 and V2 of the operational amplifier OP are matched and the size of the transistor Q1 is N times that of the transistor Q2, the emitter-base voltage difference between the transistors Q1 and Q2, $\Delta V_{EB}$, becomes:

$$\Delta V_{EB} = V_{EB2} - V_{EB1} = \frac{kT}{q}\ln N$$

Wherein $V_{EB1}$ is the emitter-base voltage of the transistor Q1, and $V_{EB2}$ is the emitter-base voltage of the transistor Q2.

Because the input voltages V1 and V2 are matched by the operational amplifier OP, the voltages V1 and V2 can be expressed as:

$$V1 = V2 = V_{EB2} = V_{EB1} + I1\times R1$$

$$I1\times R1 = V_{EB2} - V_{EB1} = \frac{kT}{q}\ln N$$

Thus, the current I1 through the resistors R2*a* and R1 can be expressed as:

$$I1 = \frac{V_T}{R1}\ln N,$$

wherein thermal voltage $$V_T = \frac{kT}{q}.$$

Because the resistors R2*a* and R2*b* are identical and the input voltages V1 and V2 are matched by the operational amplifier OP, the current I2 can be the same as the current I1.

Accordingly, $$I1 = I2 = \frac{V_T}{R1}\ln N,$$

since the thermal voltage $V_T$ has a positive temperature coefficient of 0.085 mV/° C., the currents I1 and I2 have positive temperature coefficient.

Thus, voltage V3 at the node N1 can be expressed as:

$$V3=I3\times R3=I1\times(R1+R2a)+V_{EB1}=I2\times R2b+V_{EB2}$$

Hence, the current 13 can be expressed as:

$$I3 = \frac{1}{R3}\left[V_{EB2} + \left(\frac{V_T\ln N}{R1}\times R2b\right)\right]$$

Because the emitter-base voltage $V_{EB}$ of transistors has a negative temperature coefficient of −2 mV/° C., the current I3 has a negative temperature coefficient.

As the transistors MP1 and MP2 in the current mirror CM are identical, the current I4*b* is the same as the current I4*a*, and can be expressed as:

$$I4a = I4b = I1 + I2 + I3 = 2I1 + I3 = \left(\frac{2}{R1} + \frac{R2b}{R1 \times R3}\right) \times V_T \ln N + \frac{V_{EB2}}{R3}$$

Hence, if a proper ratio of resistances of the resistors R1, R2*a*, R2*b* and R3 is selected, the current I4*a* will have a nearly-zero temperature coefficient and low sensitivity to temperature. Namely, each current mirror output (currents I4*a* and I4*b*) of the current mirror CM will have a nearly-zero temperature coefficient and low sensitivity to temperature.

Accordingly, the output voltage of the bandgap reference circuit 100A can be expressed as:

$$V_{ref} = I4b \times R4 = \left(\frac{2R4}{R1} + \frac{R2b \times R4}{R1 \times R3}\right) \times V_T \ln N + \frac{R4}{R3} \times V_{EB2}$$

It should be noted that, the resistors R2*a* and R2*b* prevents the input terminal of the operational amplifier OP from connecting directly, ensuring the operational amplifier OP can be operated normally. Without the resistor R3, the output voltage Vref of the bandgap reference circuit is limited to 1.25V, which cannot be operated in low voltage environments, in order to obtain a nearly-zero temperature coefficient. Thus, the resistor R3 is used to induce the current I3 with negative temperature coefficient to overcome such limitation, and if a proper ratio of resistances of the resistors R1, R2*a*, R2*b*, R3 and R4 is selected, the output voltage Vref will have low sensitivity to temperature and can be operated in low voltage environments.

Figure 2:
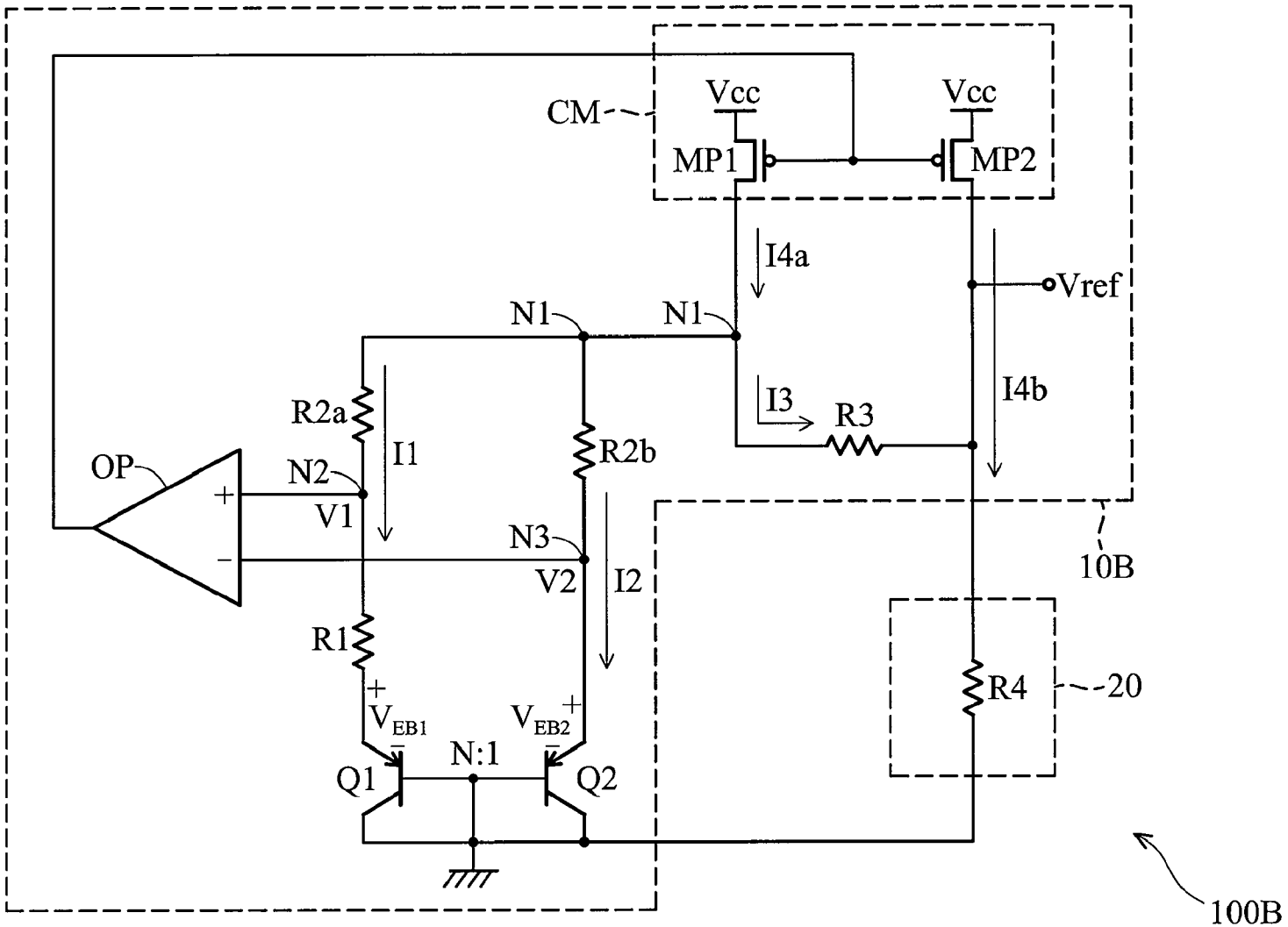
FIG. 2 shows another embodiment of a bandgap reference circuit.

FIG. 2 shows another embodiment of a bandgap reference circuit. As shown, the bandgap reference circuit 100B is similar to the circuit 100A shown in FIG. 1 except for the resistor R3. The resistor R3 is coupled between the node N1 and the resistor R4 rather than the ground voltage GND.

Similarly, currents I1 and I2 are equal and can be expressed as:

$$I1 = I2 = \frac{V_T}{R1} \ln N$$

The voltage V3 at the node N1 and the output voltage Vref can be expressed as:

$$V3 = \frac{V_T \ln N}{R1} \times R2b + V_{EB2}$$

$$Vref = R4 \times \left[\left(\frac{V3 - Vref}{R3}\right) + 2I2 + \left(\frac{V3 - Vref}{R3}\right)\right]$$

$$= R4 \times \left(\frac{2V3}{R3} - \frac{2Vref}{R3} + 2I2\right)$$

$$= \frac{1}{\left(1 + \frac{2R4}{R3}\right)}\left[\frac{R4}{R3} V_{EB2} + \left(\frac{2R2 \times R4}{R1 \times R3} + \frac{2R4}{R1}\right) V_T \ln N\right]$$

Because the emitter-base voltage $V_{EB}$ of transistors has a negative temperature coefficient of −2 mV/° C., the current I3 has a negative temperature coefficient. Hence, if a proper ratio of resistances of the resistors R1, R2*a*, R2*b*, R3 and R4 is selected, the output voltage Vref will have low sensitivity to temperature and can be operated in low voltage environments. Similarly, if a proper ratio of resistances of the resistors R1, R2*a*, R2*b*, R3 and R4 is selected, the output voltage Vref will have low sensitivity to temperature, the currents I4*a* and I4*b* can also have low sensitivity to temperature, and the description thereof is omitted for simplification.

The bandgap reference circuits 100A and 100B of the invention can act as a necessary functional block for the operation of mixed-mode and analog integrated circuits (ICs), such as data converters, phase lock-loop (PLL), oscillators, power management circuits, dynamic random access memory (DRAM), flash memory, and much more. For example, the bandgap reference circuit 100A provides the current I4*b* or the output voltage Vref to a core circuit, and the core circuit executes functions thereof accordingly.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A bandgap reference circuit, comprising:

a current mirror comprising a control terminal, a first output terminal and a second output terminal;

an operational amplifier comprising an output terminal coupled to the control terminal of the current mirror, and first and second input terminals;

a first resistor coupled between the first output terminal of the current mirror and the first input terminal of the operational amplifier;

a second resistor coupled between the first output terminal of the current mirror and the second input terminal of the operational amplifier;

a third resistor comprising a first terminal coupled to the first input terminal of the operational amplifier, and a second terminal;

a first transistor coupled between the second terminal of the third resistor and a ground voltage;

a second transistor coupled between the ground voltage and the second input terminal of the operational amplifier; and a fourth resistor coupled between the first output terminal and the second output terminal of the current mirror.

2. The bandgap reference circuit as claimed in claim 1, further comprising a fifth resistor coupled between the ground voltage and the second output terminal of the current mirror.

3. The bandgap reference circuit as claimed in claim 2, wherein the current mirror comprises:

a first MOS transistor comprising a first terminal coupled to a power voltage, a control terminal coupled to the output terminal of the operational amplifier, and a second terminal coupled to the first, the second and the fourth resistors; and a second MOS transistor comprising a first terminal coupled to the power voltage, a control terminal coupled to the output terminal of the operational amplifier, and a second terminal coupled to the fourth and the fifth resistors.

4. The bandgap reference circuit as claimed in claim 3, wherein the first resistor is identical to the second resistor.

5. The bandgap reference circuit as claimed in claim 4, wherein the first and second transistors are diode-connected bipolar transistors.

6. A bandgap reference circuit, comprising:

a first MOS transistor coupled between a power voltage and a first node;

a second MOS transistor coupled between the power voltage and an output terminal;

an operational amplifier comprising an output terminal coupled to the first and the second MOS transistors;

a first resistor coupled between the first node and the operational amplifier;

a second resistor coupled between the first node and the operational amplifier;

a third resistor coupled to the first resistor and the operational amplifier;

a first transistor coupled between the third resistor and a ground voltage;

a second transistor coupled between the ground voltage and the second resistor;

a fourth resistor coupled to the first node and coupled between the first MOS transistor and the second MOS transistor; and a fifth resistor coupled between the output terminal and the ground voltage.

7. A bandgap reference circuit, comprising:

a current mirror, in response to a control signal, producing a first current mirror output and a second current mirror output through a first output terminal and a second output terminal respectively, wherein the first current mirror output comprises first and second currents with positive temperature coefficient and a third current with negative temperature coefficient;

a first resistor coupled between the first output terminal and a first node, receiving the first current;

a second resistor coupled between the first output terminal and a second node, receiving the second current;

an operational amplifier coupled to the first node and the second node, generating the control signal to control the current mirror according to voltages on the first and second nodes;

a third resistor comprising a first terminal coupled to the first input terminal of the operational amplifier, and a second terminal;

a first transistor coupled between the second terminal of the third resistor and a ground voltage;

a second transistor coupled between the ground voltage and the second node; and a fourth resistor coupled between the first output terminal and the second output terminal of the current mirror, receiving the third current.

8. The bandgap reference circuit as claimed in claim 7, further comprising a fifth resistor coupled between the ground voltage and the second output terminal of the current mirror, receiving the second current mirror output and generating an output voltage.

9. A bandgap reference circuit, comprising:

a current generation circuit, generating an output current obtained by combining a first current, a second current and a third current, wherein the first current is converted from a first voltage and a first forward voltage of a first constant voltage generation element, and the second current and the third current are both converted from a voltage difference between the first forward voltage and a second forward voltage of the second constant voltage generation element; and a current-to-voltage generator, converting the output current to an output voltage, wherein the current generation circuit comprises: a first transistor, comprising a first terminal coupled to a power voltage, a second terminal coupled to the current-to-voltage generator, and a gate terminal:

a second transistor comprising a first terminal coupled to the power voltage, a gate terminal coupled to a gate terminal of the first transistor, and a second terminal coupled to a first node:

a first resistor coupled between the first node and the second terminal of the current-to-voltage generator:

a second resistor coupled between the first node and a second node:

a third resistor coupled between the first node and a third node:

an operational amplifier coupled to the second node and the third node. generating the control signal to control the first and the second transistors according to voltages on the second and the third nodes:

a fourth resistor comprising a first terminal coupled to the second node, and a second terminal:

a third transistor coupled between the second node and the ground voltage, comprising a control terminal coupled to the ground voltage: and a fourth transistor coupled between the third node and the ground voltage, comprising a control terminal coupled to the ground voltage.

10. The bandgap reference circuit as claimed in claim 9, wherein the first and the second constant voltage elements each comprise a diode-connected element.

* * * * *